US007828531B2

(12) United States Patent
Heng et al.

(10) Patent No.: US 7,828,531 B2
(45) Date of Patent: Nov. 9, 2010

(54) VERTICAL CENTRIFUGAL PUMP ASSEMBLY

(75) Inventors: Thomas Heng, Worms (DE); Michael Lukas, Goellheim (DE)

(73) Assignee: KSB Aktiengesellschaft, Frankenthal (DE)

( * ) Notice: Subject to any disclaimer, the term of this patent is extended or adjusted under 35 U.S.C. 154(b) by 809 days.

(21) Appl. No.: 11/056,168

(22) Filed: Feb. 14, 2005

(65) Prior Publication Data

US 2005/0191192 A1 Sep. 1, 2005

(30) Foreign Application Priority Data

Feb. 13, 2004 (DE) ..... 10 2004 007 090
Jun. 18, 2004 (DE) ..... 10 2004 029 557

(51) Int. Cl.
*F04B 17/00* (2006.01)

(52) U.S. Cl. ..... 417/423.15; 417/423.11; 417/423.14; 417/424.1

(58) Field of Classification Search ..... 417/423.14, 417/423.15, 424.1, 423.11; 285/86
See application file for complete search history.

(56) References Cited

U.S. PATENT DOCUMENTS 2,890,659 A * 6/1959 Haentjens et al. ..... 415/126
3,199,745 A * 8/1965 Hollis et al. ..... 222/324
3,776,660 A * 12/1973 Anderson et al. ..... 415/196
3,861,722 A 1/1975 Kenyon
5,716,195 A * 2/1998 Thut ..... 417/53
5,951,248 A * 9/1999 Hall ..... 415/213.1
6,315,530 B1 11/2001 Goodnick et al.

FOREIGN PATENT DOCUMENTS

DE 1 528 888 A1 10/1969
DE 2 053 147 4/1972
DE 195 07 771 A1 10/1995
EP 0 529 379 B1 3/1993

OTHER PUBLICATIONS

EPO Unofficial English Translation for DE 1 528 888 A1, dated Sep. 3, 2009.*
KSB Product Brochure 1214.1/5-10, "Etanorm Verical Low Pressure Centrifugal Pumps", Sep. 1, 2005.
European Search Report dated May 26, 2009 (two (2) pages).

* cited by examiner

*Primary Examiner*—Devon C Kramer
*Assistant Examiner*—Leonard J Weinstein
(74) *Attorney, Agent, or Firm*—Crowell & Moring LLP

(57) ABSTRACT

A vertical centrifugal pump unit, in particular for wet installation in a closed container, including an intermediate pipe (17) which surrounds the shaft (3) of the pump unit and is arranged between the housing (11) of the centrifugal pump (12) and a bracket (5) which carries the electric motor (1) of the unit. The pump unit preferably is fastened in particular to a horizontal flat part (19) arranged beneath the flange (6) of the bracket (5), especially the cover of a container. Production is simplified and it is possible to readily adapt the intermediate pipe to different sizes by designing the intermediate pipe (17) without a flange or other enlargements on its end faces, and pressing the end faces against the bracket (5) and the pump housing (11) using screw connections (18, 20) distributed uniformly around the circumference. The bracket (5) and the flat part (19) arranged beneath the bracket are joined together by the screw connections (18, 20).

14 Claims, 6 Drawing Sheets

VERTICAL CENTRIFUGAL PUMP ASSEMBLY

BACKGROUND OF THE INVENTION

The present invention relates to a vertical centrifugal pump unit, in particular for wet installation in a closed container, having an intermediate pipe which encloses the shaft of the unit and is arranged between the housing of the centrifugal pump and a bracket holding the electric motor of the pump unit, the pump unit being mounted on a flat horizontal part situated beneath the flange of the bracket, in particular on the cover of a container.

A pump unit of this type is known from U.S. Pat. No. 6,315,530. The intermediate pipe of this unit is provided with flanges by which it is attached with screws at one end to a corresponding flange on the bracket and at the other end to the pressure cover of the centrifugal pump housing. The flanges of such an intermediate pipe may be formed in one piece with the pipe body, if it is a cast part. Moreover, the flanges may be connected to a pipe by welding, although this increases the manufacturing cost. Regardless of how they are produced, all the ready-to-install intermediate pipes of this type have the disadvantage that they are adapted only to a certain shaft length. If such a centrifugal pump unit is constructed in different design lengths, then a separate casting mold is required for each length if the intermediate pipes are produced by casting. Adaptations to design lengths not provided previously are rendered difficult, if not impossible due, to the great complexity involved.

SUMMARY OF THE INVENTION

An object of the invention is to provide an improved vertical centrifugal pump unit.

Another object of the invention is to provide a vertical centrifugal pump unit which is readily adaptable to different lengths.

A further object of this invention is to provide a centrifugal pump unit in which manufacturing, adaptation and mounting of the intermediate pipe require less complexity.

These and other objects are achieved in accordance with the present invention by providing a vertical centrifugal pump unit comprising an intermediate pipe which surrounds a shaft of the unit and is arranged between a centrifugal pump housing and a bracket for supporting a pump motor, in which the pump unit is attached to a horizontally extending flat part arranged beneath a flange of the motor support bracket; the intermediate pipe is constructed without a flange or other enlargement on its end faces; the end faces of the intermediate pipe are pressed against the motor support bracket and the pump housing by screw connections, i.e. connecting screws, distributed uniformly around the pipe circumference, and the support bracket and the flat part arranged beneath the support bracket are connected together by screw connections.

In accordance with the invention, the intermediate pipe is designed without a flange or any other enlargement on its end faces, and the end faces are pressed against the bracket and the pump housing by the connecting screws distributed uniformly around the circumference, the bracket and the flat part beneath it being joined together by the screw connections.

The bracket may be provided with two circles of holes arranged at different diameters. This makes it possible to use a single embodiment of the bracket in different designs of centrifugal pump units. In the case of units having a larger diameter, the screw connections are created between the bracket, the flat part and the pump housing through the larger diameter circle of holes, whereby the screw connections at the same time accommodate the flat part situated beneath the bracket. With pump units of a smaller diameter, the connection between the bracket and the pump housing is established via the smaller diameter circle of holes, while the bracket is attached by screws to the flat part via the larger diameter circle of holes.

Mounting with the aid of a flange is proposed as an expedient alternative to fastening the unit directly to a container cover or the like. To this end, the flat part arranged beneath the bracket may be designed as a loose flange. In this way the unit may be attached to surfaces of various designs.

This invention permits a rapid and easy adjustment of the intermediate pipe length to the particular conditions without having to manufacture different embodiments of intermediate pipes and keep them on hand. The intermediate pipe which is designed without a flange or any other enlargement can be connected to the bracket and the pump housing with the help of an essentially known screw connection.

In one preferred embodiment, the intermediate pipe is clamped by tension anchors between the bracket and the pump housing, whereby in the case of use of the smaller hole circle the tension anchors at the same time accommodate the flat part arranged beneath the bracket with the help of nuts.

In accordance with another advantageous alternative, the intermediate pipe is provided with grooves extending around the entire circumference with a loose flange engaging in the grooves. This loose flange is provided with joints with the help of one or more protrusions arranged on its inside circumference and is connected by a screw connection to the flat part arranged beneath the bracket flange, in particular the cover of a container or another loose flange. The type of flange used here is essentially known in the art from published German patent application no. DE 20 53 147.

In another alternative the intermediate pipe is provided with recesses with which holding or mounting elements engage in a form-fitting manner, with the holding elements each supporting a loose flange provided with boreholes to receive screw connections. The receptacles may be comprised of individual holes into which the pins or similar elements are inserted. The loose flange then comes to rest on them.

Instead of individual holes, however, the intermediate pipe may also be provided with grooves extending around the entire circumference, each groove accommodating a supporting ring on which the loose flange comes to rest. A flange design of this type is disclosed in U.S. Pat. No. 3,861,722.

Instead of a loose flange, individual bushings distributed uniformly around the circumference may also be provided, these bushings being accommodated on pins which are in turn arranged in holes inserted into the intermediate pipe. Thus the totality of the bushings serve to accommodate the screw connection. Whereas the holes present in the bushings have smooth walls and the screw elements are formed by additional nuts, in another alternative, nuts are provided instead of the smooth bushings, and these nuts directly accommodate correspondingly designed screws or threaded bolts.

In accordance with a preferred embodiment of this invention, the end faces of the intermediate pipe are in direct contact with the flange of the bracket and with the pump housing, particularly with pressure-side cover of the pump housing. This means that flanges specifically associated with the intermediate pipe are unnecessary. This is particularly true when the diameter of the intermediate pipe corresponds to the mating surfaces of the bracket flange and/or the pump housing used for contact with its end faces.

In accordance with another advantageous embodiment of the invention, one or both end faces of the intermediate pipe are in contact with an intermediate loose flange. This makes it possible, among other things, to also use a pipe having a smaller diameter when there is a larger diameter of the contact surface on the bracket, because in this way a contact surface is made available for the intermediate pipe which is independent of the size of the bracket. The fact that a pipe with a smaller diameter can be used instead of a pipe with a larger diameter naturally yields a worthwhile economic advantage.

The advantageous idea derived from the nature of the invention (according to which the intermediate pipe is formed by conventional commercial pipe material which is, if necessary, adapted to the particular conditions through corresponding cutting to size) can also be used with an additional benefit.

Another possibility of adapting the unit to different conditions is obtained when spacers are provided between the flat part, e.g., the flange, and the bracket situated beneath the electric motor. Such spacers such as sleeves, plates, rings or grooves allow a very rapid adaptation of the unit to different depths of immersion, this adaptation optionally being performed at the site of use. Thus the centrifugal pump unit according to the invention replaces all embodiments in which the shaft and intermediate housing lengths individually are within the adjustment range of the aforementioned advantageous embodiment.

It is also within the scope of this invention to integrate intermediate bearings for the shaft in the intermediate pipe of the centrifugal pump unit. For such a bearing arranged in the intermediate pipe, two advantageous alternatives may be mentioned.

In a first embodiment, an intermediate bearing is used, held in position by a plurality of screws extending through the intermediate pipe. In a preferred embodiment, this can be accomplished by three screws distributed uniformly around the circumference, to be locked in place by nuts and counternuts, each adjustable with the help of a thread provided in the intermediate pipe.

In a second embodiment, an intermediate pipe subdivided into two similar halves is used. A carrier for an intermediate bearing, having contours adapted to the end faces of the intermediate pipe halves, is clamped between the two halves.

In a preferred embodiment of this invention, the intermediate bearing is supplied with a lubricating fluid through a lubricant supply line. In a preferred embodiment, this line may be connected to the pressure-side interior area of the centrifugal pump unit.

BRIEF DESCRIPTION OF THE DRAWINGS

The invention will be described in further detail hereinafter with reference to illustrative preferred embodiments shown in the accompanying drawing figures in which.

DETAILED DESCRIPTION OF PREFERRED EMBODIMENTS

Figure 1:
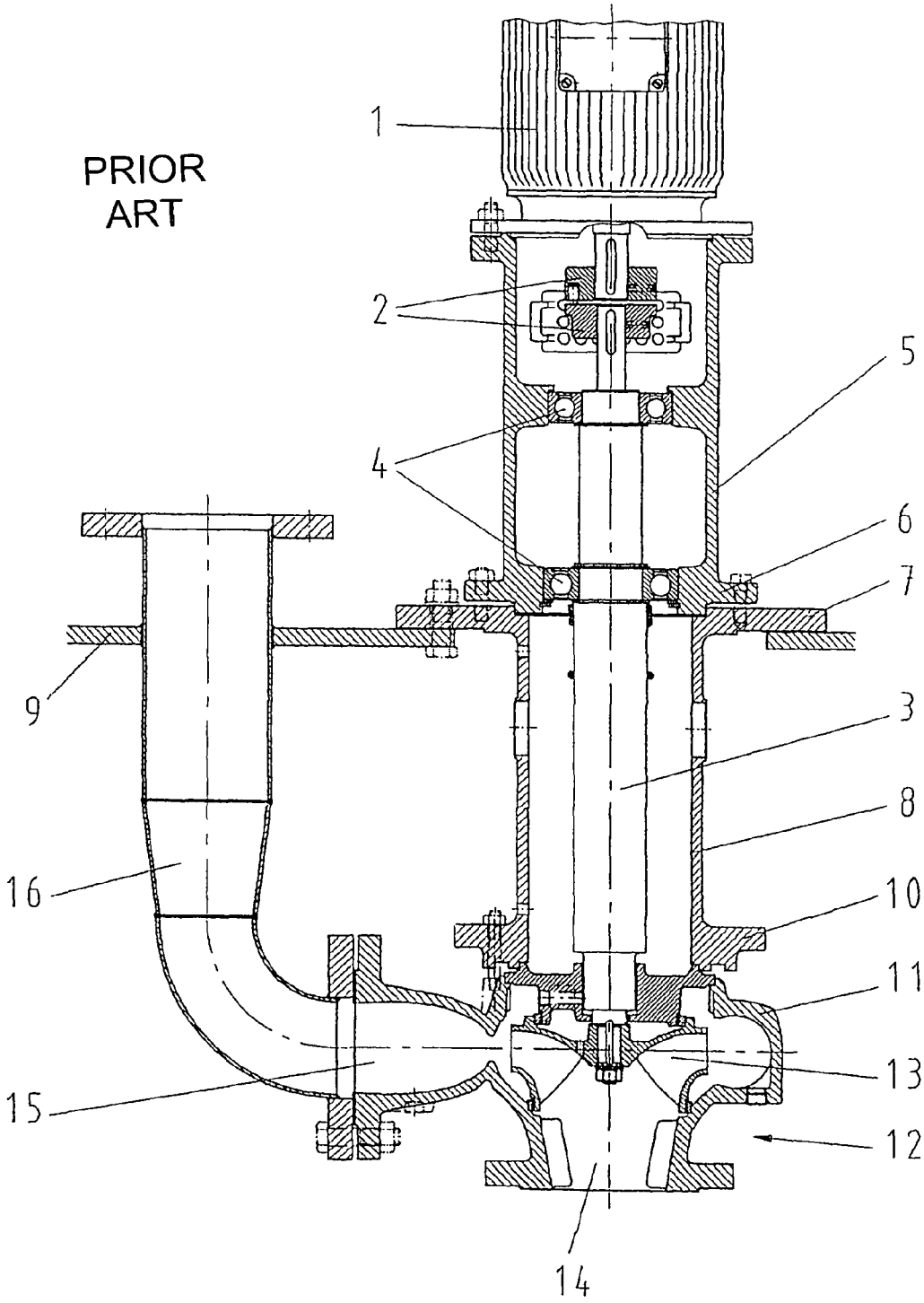
FIG. 1 shows a prior art centrifugal pump unit, having a self-supporting pump unit shaft mounted only on a single bracket.

The centrifugal pump unit which corresponds to the state of the art and is illustrated in FIG. 1 has an electric motor 1 which is connected by a coupling 2 to the pump unit shaft 3. The pump unit shaft 3 is rotatably mounted in a bracket 5 by two bearings 4. On its lower end the bracket 5 has a flange 6 which is detachably connected by a plurality of screws to a flange 7 of an intermediate pipe 8. The flange 7 of the intermediate pipe 8 is in turn connected to the cover 9 of a container (not shown) by means of screws.

The intermediate pipe 8 thus protrudes into the container and surrounds the pump unit shaft 3. On its lower end, the intermediate pipe 8 has a flange 10 which is detachably connected to the housing 11 of a centrifugal pump 12—also via a plurality of screws. The centrifugal pump 12 has a rotor 13 which draws in fluid that is in the container through an inlet 14 and propels it outward through an outlet 15 and a discharge pipe 16 into a pipeline (not shown here) outside of the container.

The intermediate pipe 8 with its flanges 7 and 10 is manufactured in one piece in a casting operation. This means that a separate casting model must be kept on hand for each size of the intermediate pipe to be used, and intermediate pipes deviating from a specified size can be made available only with a great increase in expense.

Figure 2:
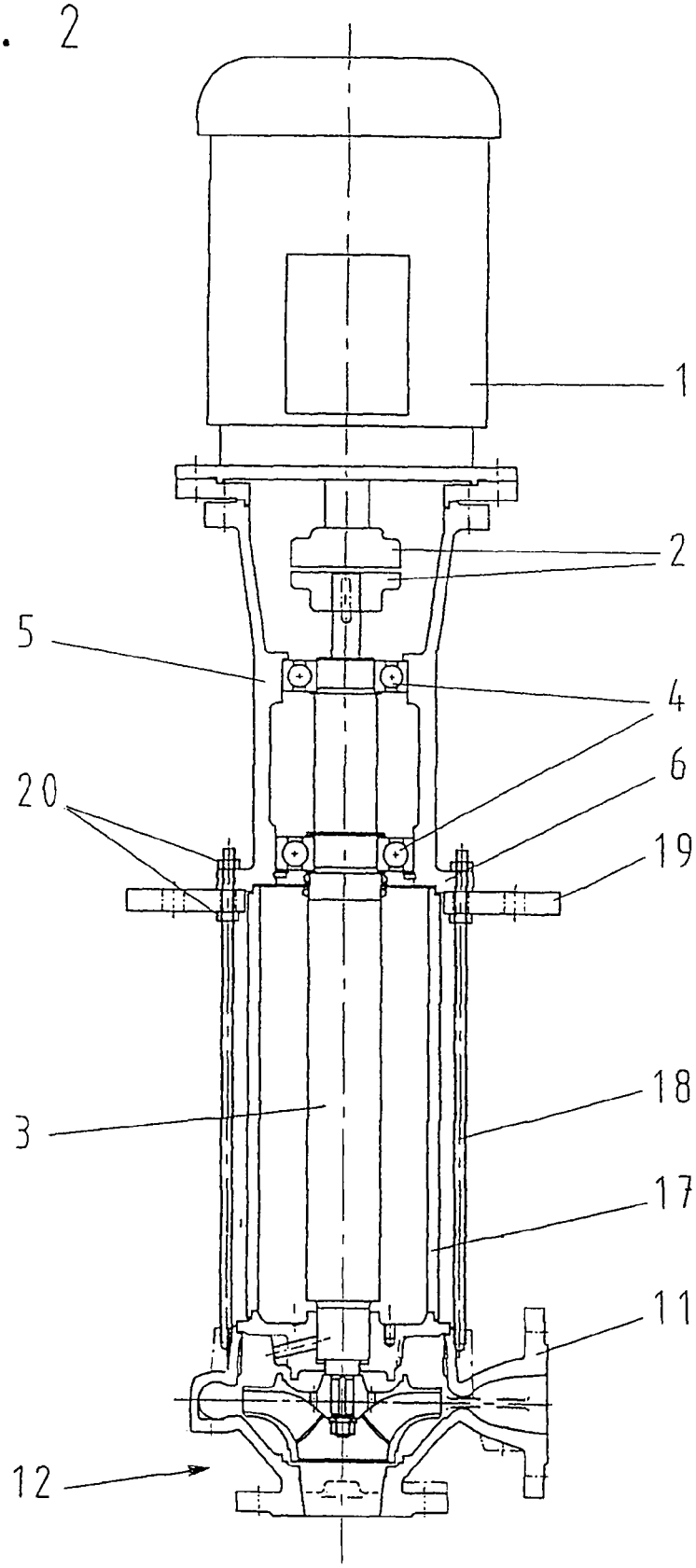
FIG. 2 shows a centrifugal pump unit according to this invention, having a shaft which is designed to be self-supporting.
Figure 3:
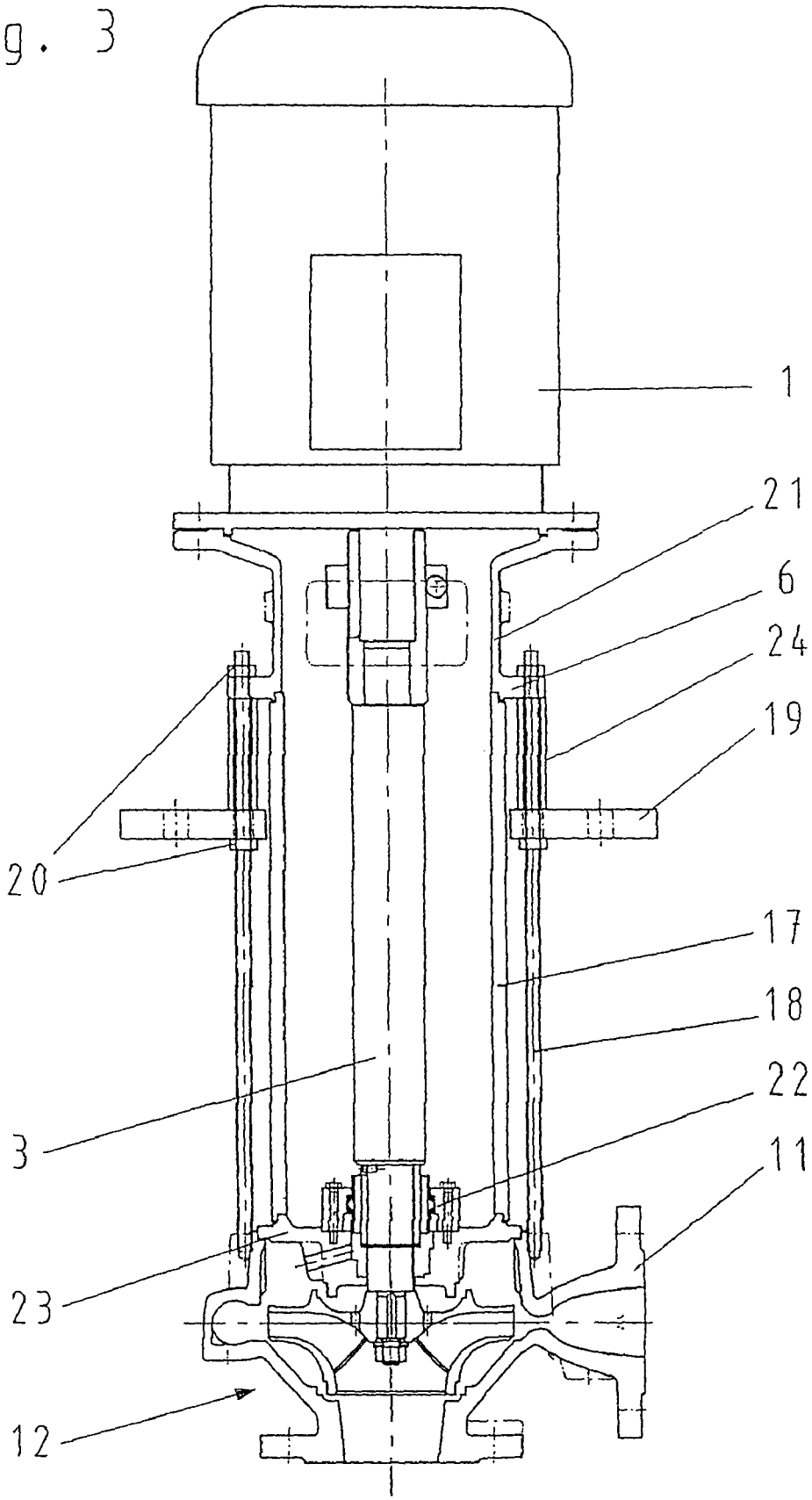
FIG. 3 shows a pump unit illustrating a variant of the invention in which the pump shaft is mounted on the housing of the pump.

The embodiments illustrated in FIGS. 2 and 3 overcome the problems described above by making available a theoretically unlimited number of possible sizes of intermediate pipes. This is made possible by the fact that the intermediate pipes are designed only as simple pipes, i.e., flanges are not included. This yields several advantageous possibilities: the existing pipe material can readily be cut to a desired dimension, and production and warehousing are thus simplified. In particular, it is now possible to use conventional commercial pipe formats, which is an important economic advantage because of the avoidance of separate production of the intermediate pipes.

The embodiments of the invention illustrated in FIG. 2 and FIG. 3 have many of the same elements as the prior art embodiment shown in FIG. 1. This is illustrated by the fact that similar parts in the illustrated embodiments are identified by the same reference numbers. However, the devices differ in various details as a result of the inventive design of the two embodiments shown in FIG. 2 and FIG. 3.

In the centrifugal pump unit of FIG. 2, an intermediate pipe 17 which is clamped between the flange 6 of the bracket 5 and the pump housing 11 by means of tension anchors 18 is used. In addition, a loose flange 19 is accommodated by the tension anchors 18 and serves to attach the unit to a container (not shown). The loose flange 19 which is in direct contact with the flange 6, is put under tension by nuts 20 which are in contact beneath the loose flange and above the flange 6.

Instead of fastening the unit with the help of a loose flange, however, the unit may also be attached directly to a container cover. The type of fastening itself would be essentially the same as that shown in FIG. 2.

The embodiment of FIG. 3 has a comparatively short bracket 21 in which no bearings for the pump unit shaft 3 are provided. Instead, a friction bearing 22 is arranged on the cover 23 of the pump housing 11 for mounting the shaft 3.

This is a known type of mounting. However, an unconventional aspect of this device is the arrangement of the flange 19.

The flange 19 is displaced in the direction of the pump housing 11 by sleeves 24 which are placed on the tension anchor 18. The depth at which the unit is immersed in a container or the like is thereby reduced. In other words, with the aid of such sleeves 24, a rapid and uncomplicated adaptation to different depths of immersion can be effected at any time. The centrifugal pump unit may thus be used in variable ways.

Instead of the sleeves 24, differently designed spacers such as disks or plates may also be used. Rings or pipes covering the entire circumference of the flange may also be used. Finally, it is also possible to establish the desired distance by using additional positioning nuts which are arranged above the loose flange 19 and below the bracket 6.

Figure 4:
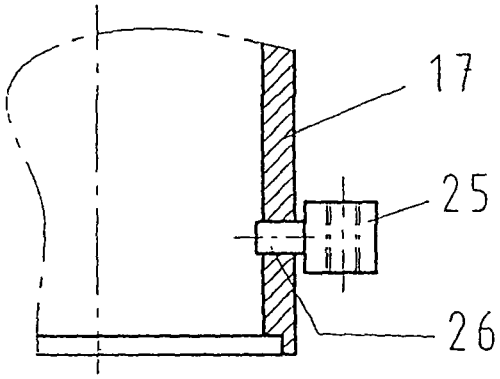
FIGS. 4 through 6 show details of alternative forms of mounting the unit.
Figure 5:
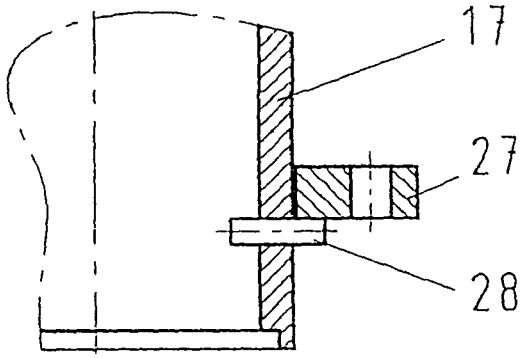

FIGS. 4 and 5 show elements of two mounting arrangements that are alternatives to tension anchors.

FIG. 4 shows nuts 25 which are welded to pins 26. The pins 26 are anchored in boreholes in the intermediate pipe 17. The required screw connection is established by screws or threaded bolts (not shown).

FIG. 5 shows an embodiment in which a (second) loose flange 27 is used. The loose flange 27 is supported on a plurality of pins 28 which are arranged distributed uniformly around the circumference of the intermediate pipe 17. Instead of the pins 28 inserted into individual holes, a snap ring arranged in a circumferential groove on the intermediate pipe 17 may be used with a similar effect. A divided loose flange arranged in a groove of the intermediate pipe and secured by the screw connection yet to be established may also be used instead.

Figure 6:
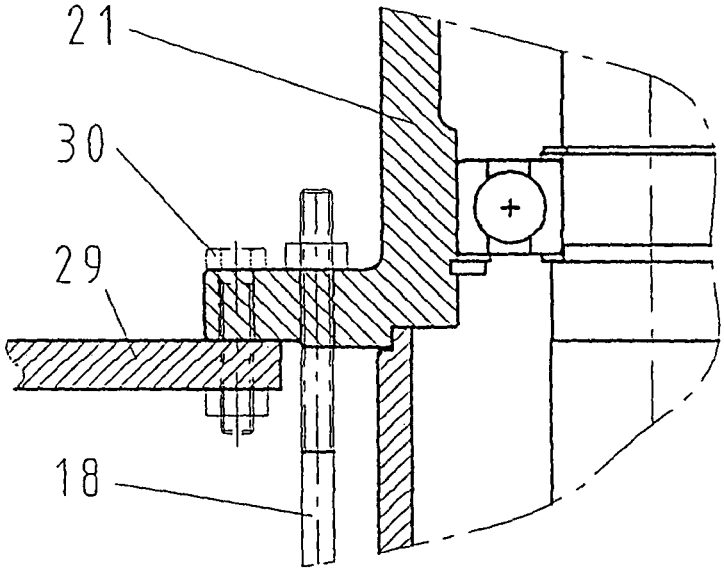

FIG. 6 shows an alternative manner of connection between a bracket 21 and a flat part 29. The bracket 21 is provided with two different diameter circles of holes. This allows use with units of different sizes. In the embodiment shown here, there is a connection with a smaller unit. The flange of the bracket 21 here is connected to the flat part 29 by screws 30 on one end and is connected to the pump housing 11 by tension anchors 18 on the other end. In the case of a larger unit, there would be a direct connection between the bracket 21 and the flat part 29 by tension anchors 18 via the outer circle of holes. This type of connection would correspond to that depicted in FIG. 2.

Figure 7:
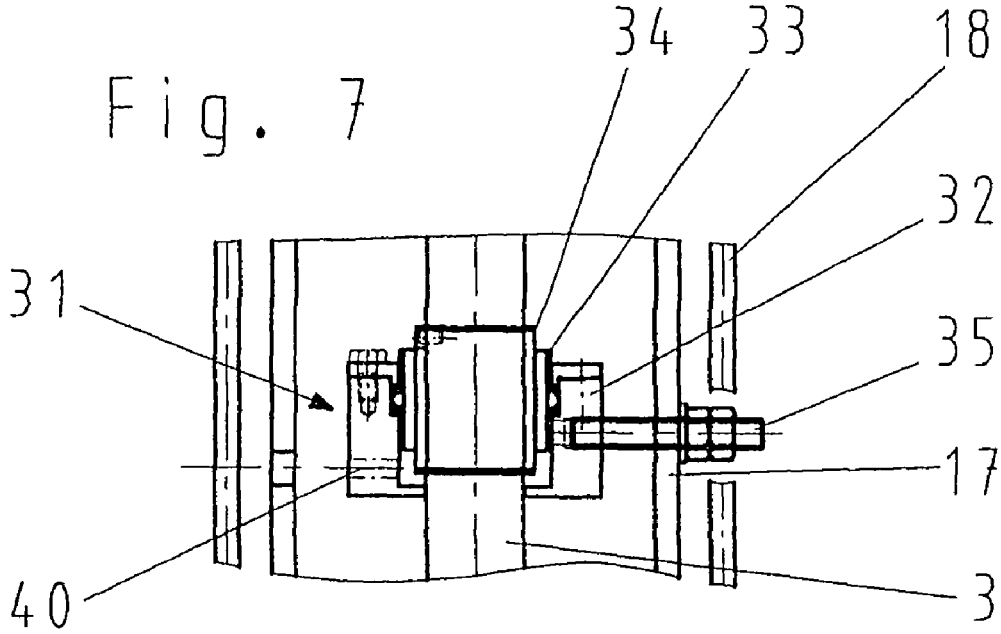
FIGS. 7 and 8 show two views of an intermediate bearing for the shaft of a centrifugal pump unit according to the invention.
Figure 8:
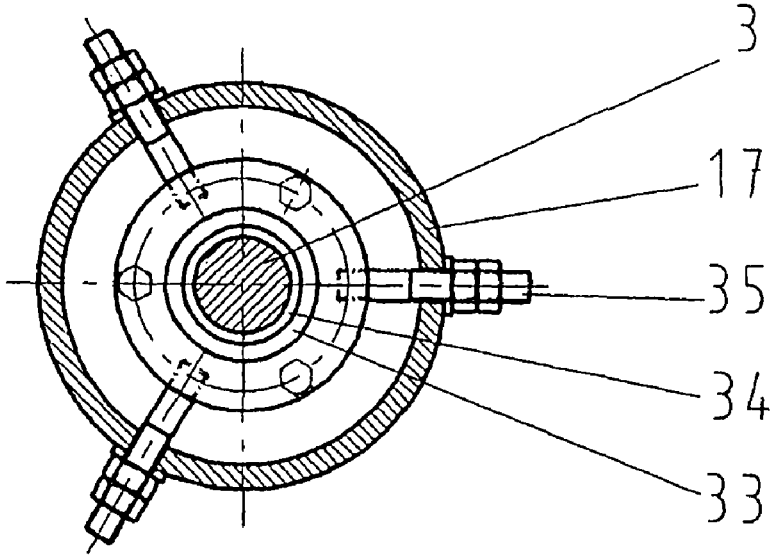

FIGS. 7 and 8 show an intermediate bearing 31 arranged in the intermediate pipe 17. The intermediate bearing 31 is comprised of a bearing support 32 and a bearing shell 33 attached to it. The shaft 3 in turn carries a bearing bushing 34 which cooperates with the bearing shell 33. The bearing carrier 32 is mounted by stud bolts 35 in the intermediate pipe 17. The intermediate bearing 31 is installed and aligned in such a manner that the intermediate bearing 31 is first premounted with loose screw connections in the intermediate pipe 17 and is secured by uniform tightening of the stud bolts 35 only after the shaft 3 has been pushed through the bearing.

Figure 9:
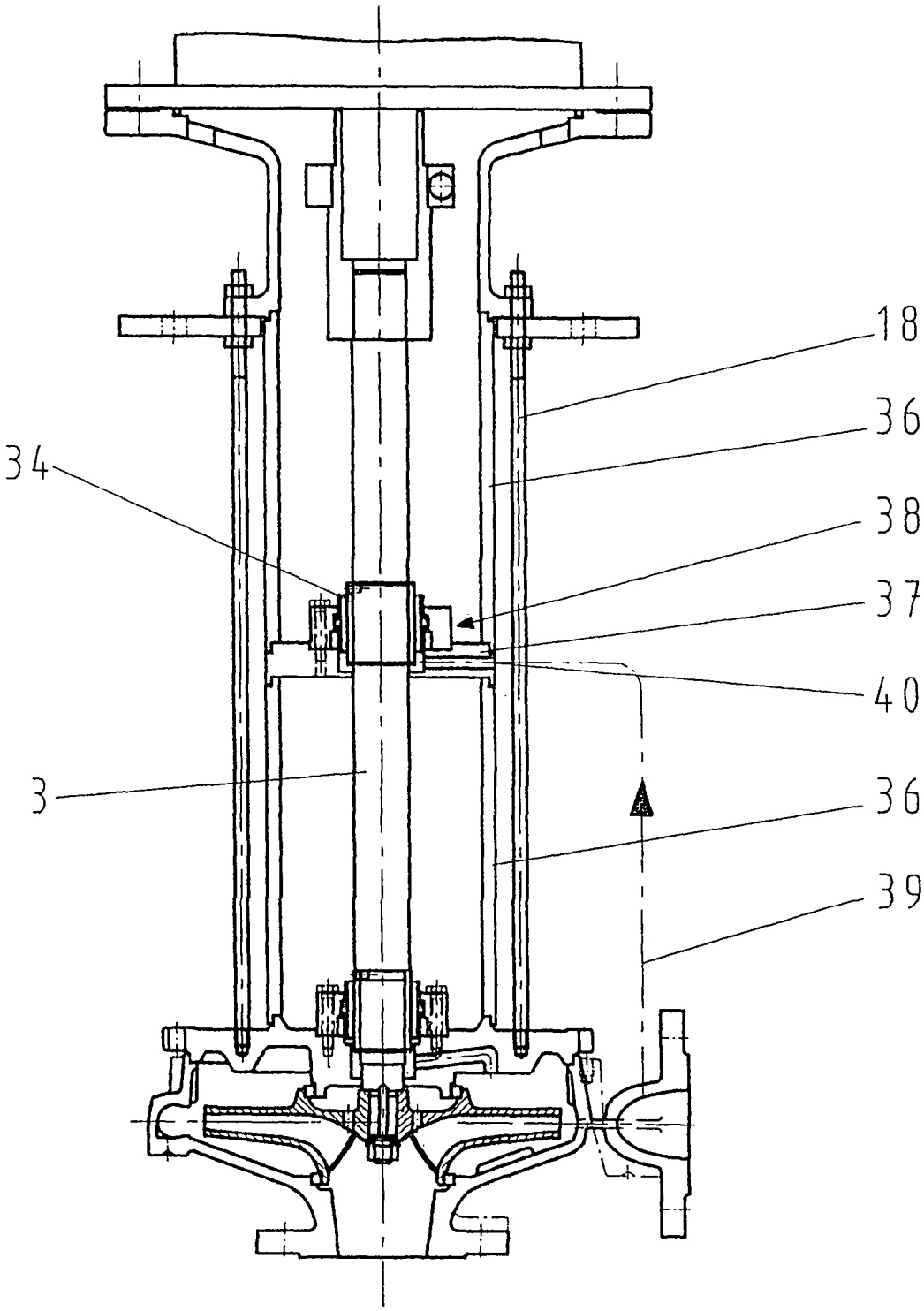
FIG. 9 shows a centrifugal pump unit according to the invention, with another possible design of the intermediate bearing.

FIG. 9 shows an embodiment in which two identically constructed pipes 36 have been joined together axially to form a common intermediate pipe. A bearing carrier 37 is clamped between the two pipes 36, being put under tension by tension anchors 18 together with the pipes 36. Here again, the intermediate bearing 38 held by the bearing carrier 37 also encloses a bushing 34 arranged on the shaft 3.

The bearings 31 and 38 in FIGS. 7 through 9 each have a lubricated bearing which is supplied with liquid lubricant through a lubricant supply line 39 which is connected to the pressure side of the pump unit. The line 39 opens into a borehole 40 in the bearing carrier 32 and/or 37.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A vertical centrifugal pump unit comprising an intermediate pipe which surrounds a shaft of the centrifugal pump unit and is arranged between a centrifugal pump housing and a bracket for supporting a pump motor, wherein the centrifugal pump unit is designed for wet installation in a closed container;

the centrifugal pump unit is attached to a horizontally extending flat part arranged beneath a flange of the bracket;

the intermediate pipe is constructed without a flange or other enlargement on its end faces;

the end faces of the intermediate pipe are pressed against the bracket and the centrifugal pump housing by screw connections distributed uniformly around the intermediate pipe circumference; and the bracket and the horizontally extending flat part arranged beneath the flange of the bracket are connected together by said screw connections flange of the bracket are connected together by screw connections, and the intermediate pipe is formed by a piece of conventional commercial pipe stock cut to length to adapt it to prevailing conditions at an installation site.

2. A centrifugal pump unit according to claim 1, wherein said horizontally extending flat part is a cover of the container.

3. A centrifugal pump unit according to claim 1, wherein the intermediate pipe is clamped by tension anchors, and the tension anchors are attached by said screw connections at one end to the bracket and at their other end to the centrifugal pump housing.

4. A centrifugal pump unit according to claim 1, wherein the end faces of the intermediate pipe contact the flange of the bracket and the centrifugal pump housing, respectively.

5. A centrifugal pump unit according to claim 4, wherein the intermediate pipe end face which contacts the centrifugal pump housing, contacts a centrifugal pump housing cover on the pressure side of the pump.

6. A centrifugal pump unit according to claim 1, wherein the intermediate pipe is cut to length on site to adapt it to the prevailing conditions.

7. A centrifugal pump unit according to claim 1, further comprising spacers arranged between the horizontally extending flat part and the bracket.

8. A centrifugal pump unit according to claim 7, wherein the spacers are formed by sleeves.

9. A centrifugal pump unit according to claim 7, wherein the spacers comprise nuts arranged above the horizontally extending flat part and beneath the bracket.

10. A centrifugal pump unit, comprising an intermediate pipe which surrounds a shaft of the centrifugal pump unit and is arranged between a centrifugal pump housing and a bracket for supporting a pump motor, wherein the centrifugal pump unit is designed for wet installation in a closed container;

the centrifugal pump unit is attached to a horizontally extending flat part arranged beneath a flange of the bracket;

the intermediate pipe is constructed without a flange or other enlargement on its end faces;

the end faces of the intermediate pipe are pressed against the bracket and the centrifugal pump housing by screw connections distributed uniformly around the intermediate pipe circumference;

the bracket and the horizontally extending flat part arranged beneath the flange of the bracket are connected together by said screw connections; and the bracket is provided with two circles of holes arranged at different diameters.

11. A centrifugal pump according to claim 10, wherein said screw connections comprise a first and second set of screw connections, wherein said first set of screw connections are provided between the pump housing and the bracket through the smaller diameter circle of holes in the bracket, and said second set of screws connections for connecting the horizontally extending flat part to the bracket are provided through the larger diameter circle of holes in the bracket.

12. A centrifugal pump according to claim 10, wherein said screw connections between the horizontally extending flat part and the bracket are provided through the larger diameter circle of holes in the bracket, and said screw connections simultaneously receive the horizontally extending flat part which is arranged beneath the flange of the bracket.

13. A centrifugal pump unit, comprising an intermediate pipe which surrounds a shaft of the centrifugal pump unit and is arranged between a centrifugal pump housing and a bracket for supporting a pump motor, wherein the centrifugal pump unit is designed for wet installation in a closed container;

the centrifugal pump unit is attached to a horizontally extending flat part arranged beneath a flange of the bracket;

the intermediate pipe is constructed without a flange or other enlargement on its end faces;

the end faces of the intermediate pipe are pressed against the bracket and the centrifugal pump housing by screw connections distributed uniformly around the intermediate pipe circumference;

the bracket and the horizontally extending flat part arranged beneath the flange of the bracket are connected together by said screw connections; and the horizontally extending flat part arranged beneath the bracket is a loose flange.

14. A centrifugal pump unit according to claim 13, wherein the intermediate pipe is provided with grooves extending around its entire circumference, and each groove accommodates a supporting ring against which the loose flange rests.

* * * * *